US008752386B2

(12) United States Patent
Fox et al.

(10) Patent No.: US 8,752,386 B2
(45) Date of Patent: Jun. 17, 2014

(54) AIR/FUEL SUPPLY SYSTEM FOR USE IN A GAS TURBINE ENGINE

(75) Inventors: Timothy A. Fox, Hamilton (CA); Reinhard Schilp, Orlando, FL (US); Domenico Gambacorta, Oviedo, FL (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 1045 days.

(21) Appl. No.: 12/786,930

(22) Filed: May 25, 2010

(65) Prior Publication Data

US 2011/0289928 A1 Dec. 1, 2011

(51) Int. Cl.
*F02C 7/22* (2006.01)

(52) U.S. Cl.
USPC ..... 60/737; 60/740; 60/748; 60/734; 60/738; 60/742; 60/746

(58) Field of Classification Search
USPC ..... 60/740, 748, 734, 737, 738, 742, 746, 60/747
See application file for complete search history.

(56) References Cited

U.S. PATENT DOCUMENTS

| | | | | |
|---|---|---|---|---|
| 3,872,664 | A | 3/1975 | Lohmann et al. | |
| 4,192,139 | A | 3/1980 | Buchheim | |
| 4,265,615 | A | 5/1981 | Lohmann et al. | |
| 4,845,952 | A * | 7/1989 | Beebe | 60/737 |
| 5,259,184 | A * | 11/1993 | Borkowicz et al. | 60/39.55 |
| 5,394,688 | A | 3/1995 | Amos | |
| 5,423,178 | A | 6/1995 | Mains | |
| 5,713,205 | A | 2/1998 | Sciocchetti et al. | |
| 5,749,219 | A | 5/1998 | DuBell | |
| 5,826,429 | A | 10/1998 | Beebe et al. | |
| 5,850,731 | A | 12/1998 | Beebe et al. | |
| 5,899,075 | A * | 5/1999 | Dean et al. | 60/737 |
| 6,047,550 | A | 4/2000 | Beebe | |
| 6,192,688 | B1 | 2/2001 | Beebe | |
| 6,453,830 | B1 | 9/2002 | Zauderer | |
| 6,868,676 | B1 | 3/2005 | Haynes | |
| 6,968,693 | B2 * | 11/2005 | Colibaba-Evulet et al. | 60/748 |
| 6,993,916 | B2 * | 2/2006 | Johnson et al. | 60/776 |
| 7,021,562 | B2 | 4/2006 | Mansour et al. | |
| 7,028,483 | B2 | 4/2006 | Mansour et al. | |
| 7,047,748 | B2 | 5/2006 | Zauderer | |
| 7,093,438 | B2 * | 8/2006 | Dinu et al. | 60/737 |
| 8,181,891 | B2 * | 5/2012 | Ziminsky et al. | 239/430 |
| 8,209,986 | B2 * | 7/2012 | Lacy et al. | 60/737 |
| 8,424,311 | B2 * | 4/2013 | York et al. | 60/737 |
| 2008/0078182 | A1 * | 4/2008 | Evulet | 60/776 |
| 2008/0289341 | A1 * | 11/2008 | Ishizaka et al. | 60/748 |
| 2011/0005232 | A1 * | 1/2011 | Williams et al. | 60/748 |

OTHER PUBLICATIONS

U.S. Appl. No. 12/555,134, filed Sep. 8, 2009 entitled, "Fuel Injector for Use in a Gas Turbine Engine".

* cited by examiner

*Primary Examiner* — Phutthiwat Wongwian
*Assistant Examiner* — Steven Sutherland

(57) ABSTRACT

A fuel injector for use in a gas turbine engine combustor assembly. The fuel injector includes a main body and a fuel supply structure. The main body has an inlet end and an outlet end and defines a longitudinal axis extending between the outlet and inlet ends. The main body comprises a plurality of air/fuel passages extending therethrough, each air/fuel passage including an inlet that receives air from a source of air and an outlet. The fuel supply structure communicates with and supplies fuel to the air/fuel passages for providing an air/fuel mixture within each air/fuel passage. The air/fuel mixtures exit the main body through respective air/fuel passage outlets.

20 Claims, 5 Drawing Sheets

AIR/FUEL SUPPLY SYSTEM FOR USE IN A GAS TURBINE ENGINE

This invention was made with U.S. Government support under Contract Number DE-FC26-05NT42644 awarded by the U.S. Department of Energy. The U.S. Government has certain rights to this invention.

FIELD OF THE INVENTION

The present invention relates to an air/fuel supply system for use in a gas turbine engine, and, more particularly, to an air/fuel supply system that includes a plurality of fuel injectors that distributes fuel into a combustor downstream from a main combustion zone of the combustor.

BACKGROUND OF THE INVENTION

In gas turbine engines, fuel is delivered from a fuel source to a combustion section where the fuel is mixed with air and ignited to generate hot combustion products that define working gases. The working gases are directed to a turbine section where they effect rotation of a turbine rotor. It has been found that the production of NOx gases from the burning fuel in the combustion section can be reduced by providing a portion of the fuel to be ignited downstream from a main combustion zone.

SUMMARY OF THE INVENTION

In accordance with a first aspect of the present invention, a fuel injector is provided for use in a combustor assembly of a gas turbine engine. The fuel injector comprises a main body and a fuel supply structure. The main body has an inlet end and an outlet end and defines a longitudinal axis extending between the outlet end and the inlet end. The main body comprises a plurality of air/fuel passages extending therethrough, each air/fuel passage including an inlet that receives air from a source of air and an outlet. The fuel supply structure communicates with and supplies fuel to the air/fuel passages for providing an air/fuel mixture within each air/fuel passage. The air/fuel mixtures exit the main body through respective air/fuel passage outlets.

In accordance with a second aspect of the invention, an air/fuel supply system is provided for use in a combustor assembly of a gas turbine engine. The air/fuel supply system comprises a fuel injector, which comprises a main body and a fuel supply structure. The main body has an inlet end and an outlet end and defines a longitudinal axis extending between the outlet end and the inlet end. The main body comprises a plurality of air/fuel passages extending therethrough, each air/fuel passage including an inlet that receives air from a source of air and an outlet. The fuel supply structure is located in the main body and includes at least one fuel inlet that receives fuel from a source of fuel and a plurality of fuel outlets, each fuel outlet communicating with and supplying fuel to at least one of the air/fuel passages. Air passing through each air/fuel passage is mixed with fuel from at least one of the fuel outlets, the mixing occurring within each air/fuel passage to produce an air/fuel mixture within each air/fuel passage. The air/fuel mixture within each air/fuel passage exits the outlet end of the main body through a respective air/fuel passage outlet.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
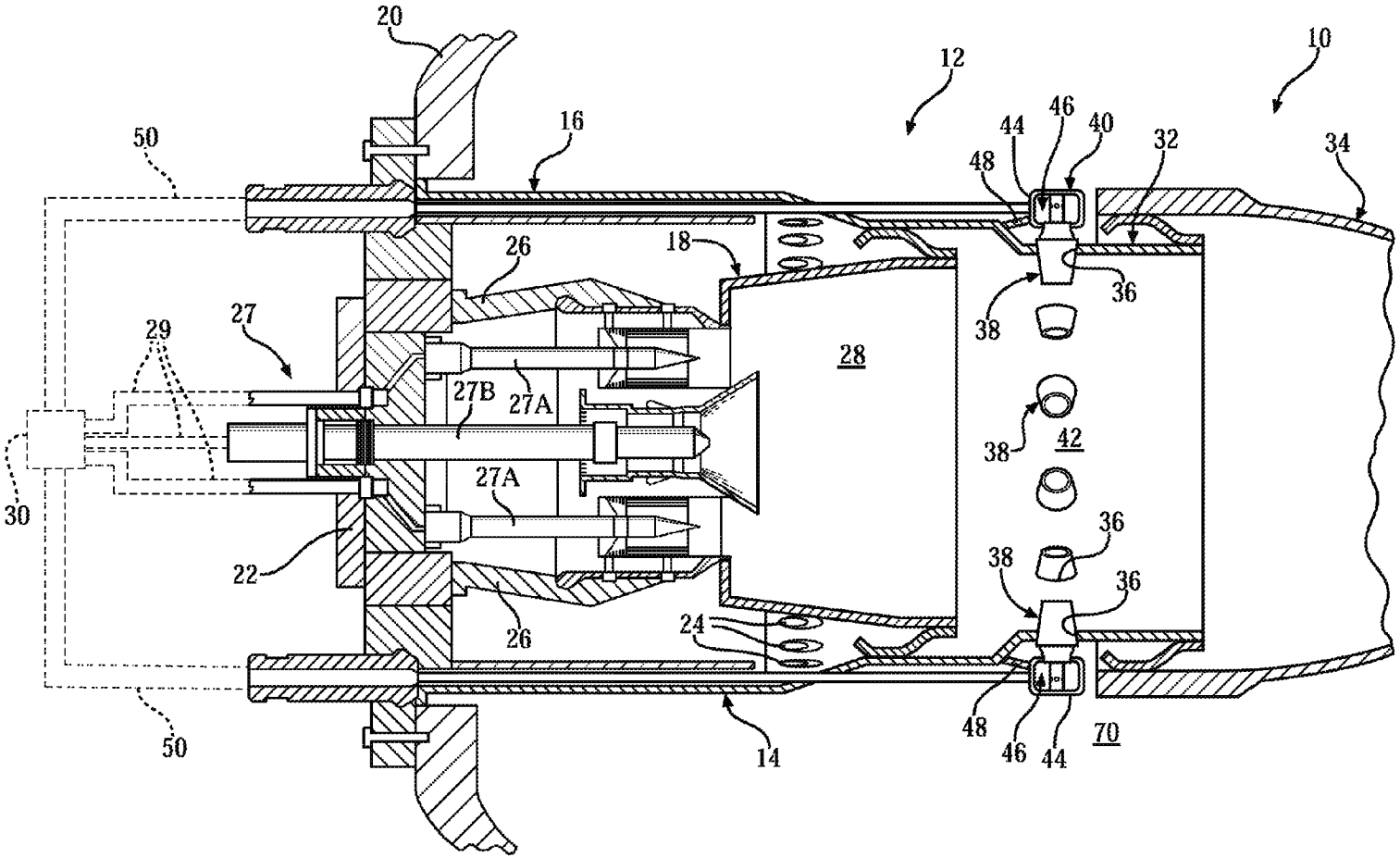
FIG. 1 is a side cross sectional view of a combustor assembly according to an embodiment of the invention.

Referring to FIG. 1, a single combustor assembly 12 of a can-annular combustion system 10 included in a gas turbine engine is illustrated. Each combustor assembly 12 forming a part of the can-annular combustion system 10 can be constructed in the same manner as the combustor assembly 12 illustrated in FIG. 1. Hence, only the combustor assembly 12 illustrated in FIG. 1 will be discussed in detail herein. The combustor assemblies 12 are spaced circumferentially apart from one another in the combustion system 10, as will be apparent to those skilled in the art.

The combustor assembly 12 includes a combustor device 14, which comprises a flow sleeve 16 and a liner 18 disposed radially inwardly from the flow sleeve 16, see FIG. 1. The flow sleeve 16 is coupled to a main casing 20 of the gas turbine engine via a cover plate 22 and receives pressurized air therein from a compressor section (not shown) of the engine through inlet apertures 24 formed in the flow sleeve 16. The flow sleeve 16 may be formed from any material capable of operation in the high temperature and high pressure environment of the combustion system 10, such as, for example, stainless steel, and in a preferred embodiment may comprise a steel alloy including chromium.

The liner 18, also referred to herein as a first duct structure, is coupled to the cover plate 22 via support members 26 and at least partially defines a main combustion zone 28 where air and fuel are ignited, as will be discussed herein. The liner 18 may be formed from a high-temperature material, such as HASTELLOY-X (HASTELLOY is a registered trademark of Haynes International, Inc.).

As shown in FIG. 1, a first fuel injection system 27 of the combustor assembly 12 comprises one or more main fuel injectors 27A coupled to and extending axially away from the cover plate 22, and a pilot fuel injector 27B also coupled to and extending axially away from the cover plate 22. The first fuel injection system 27 may also be referred to as a "main," a "primary," or an "upstream" fuel injection system.

A first fuel supply structure 29 in fluid communication with a source of fuel 30 delivers fuel from the source of fuel 30 to the main and pilot fuel injectors 27A and 27B. As noted above, the flow sleeve 16 receives pressurized air from the compressor through the flow sleeve inlet apertures 24. The pressurized air is mixed with fuel from the main and pilot fuel injectors 27A and 27B and ignited in the main combustion zone 28 creating combustion products comprising hot working gases. The combustor assembly 12 further includes an intermediate duct 32 located downstream from the liner 18 and a transition duct 34 downstream from the intermediate duct 32.

The intermediate duct 32, also referred to herein as a second duct structure, may be formed from any material capable of operation in the high temperature and high pressure environment of the combustion system 10, such as, for example, stainless steel, and in a preferred embodiment may comprise a steel alloy including chromium. The intermediate duct 32 is located between the liner 18 and the transition duct 34 so as to define a path for the first working gases to flow from the liner 18 to the transition duct 34. In the embodiment shown in FIG. 1, the intermediate duct 32 is integral with the flow sleeve 16, although it is understood that the intermediate duct 32 may be separate from the flow sleeve 16. Additional details in connection with the intermediate duct 32 can be found in U.S. patent application Ser. No. 12/431,302, filed Apr. 28, 2009, entitled "COMBUSTOR ASSEMBLY IN A GAS TURBINE ENGINE," the entire disclosure of which is hereby incorporated by reference herein.

The transition duct 34, also referred to herein as a third duct structure, may comprise a conduit formed from a high-temperature capable material, such as HASTELLOY-X, INCONEL 617, or HAYNES 230 (INCONEL is a registered trademark of Special Metals Corporation, and HAYNES is a registered trademark of Haynes International, Inc.), and conveys the hot working gases created in the combustor assembly 12 to a turbine section (not shown) of the engine.

Figures 2, 3, 4:
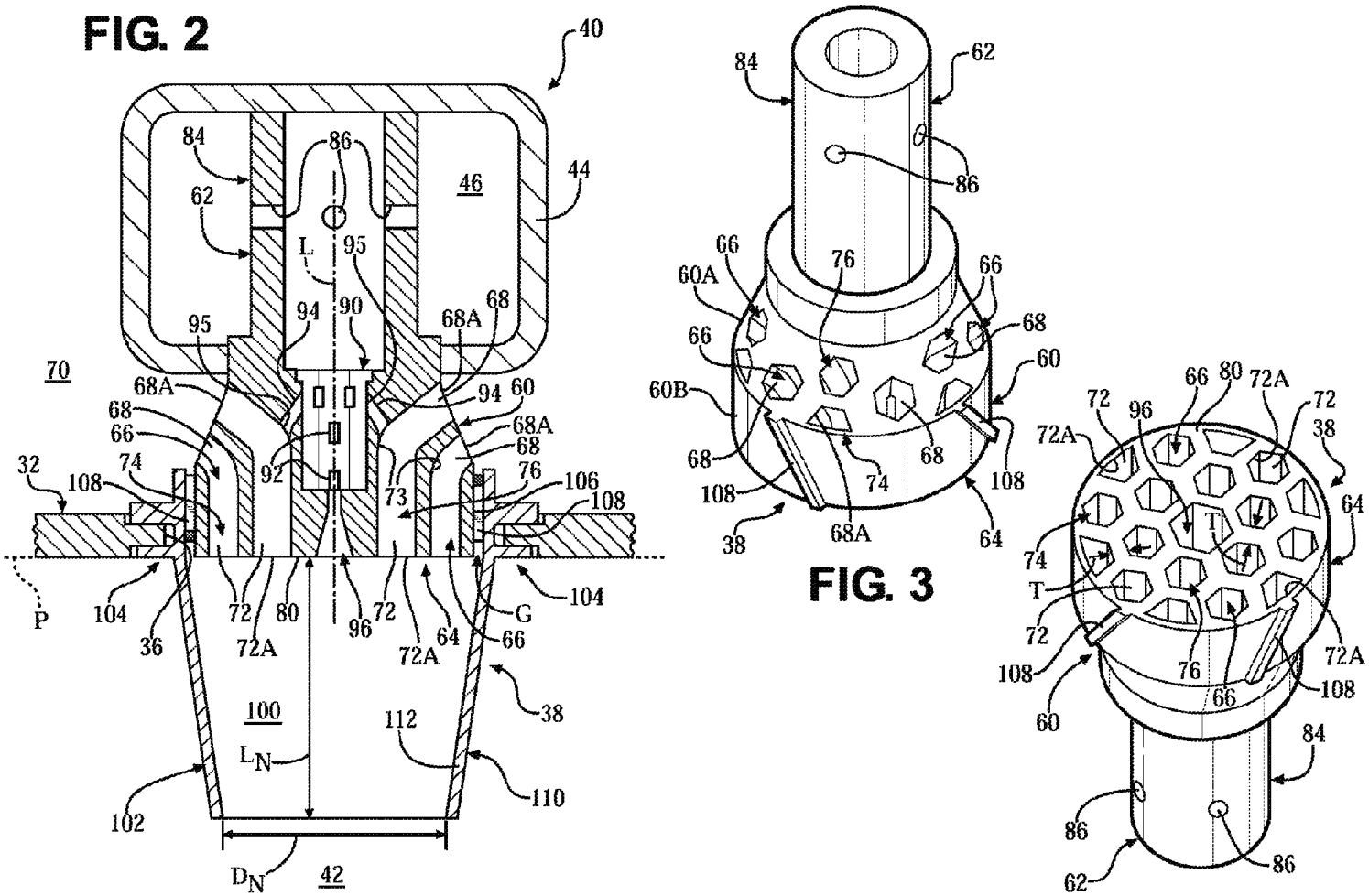
FIG. 2 is an enlarged cross sectional view illustrating an air/fuel supply system of the combustor assembly shown in FIG. 1.
FIG. 3 is a perspective view illustrating an inlet end of a fuel injector of the air/fuel supply system illustrated in FIG. 2.
FIG. 4 is a perspective view illustrating an outlet end of the fuel injector illustrated in FIG. 3 without a nozzle structure.

In the embodiment shown, a plurality of secondary fuel injection apertures 36 are formed in the intermediate duct 32, see FIGS. 1 and 2. The secondary fuel injection apertures 36 are each adapted to receive a corresponding downstream fuel injector 38 of an air/fuel supply system 40. The air/fuel supply system 40 may also be referred to as a "downstream," a "secondary," or a "second" fuel injection system.

Referring to FIGS. 1 and 2, each fuel injector 38 of the air/fuel supply system 40 extends through a corresponding one of the secondary fuel injection apertures 36 formed in the intermediate duct 32 so as to communicate with and inject a mixture of air and fuel (hereinafter air/fuel mixture) into a secondary combustion zone 42 defined by the intermediate duct 32 at a location downstream from the main combustion zone 28. The air/fuel mixtures injected by the fuel injectors 38 into the intermediate duct 32 enter a flow of the combustion products from the main combustion zone 28, which combustion products ignite the air/fuel mixtures from the fuel injectors 38, thereby producing additional working gases. It is noted that, while the fuel injectors 38 of the air/fuel supply system 40 illustrated in FIG. 1 extend through the secondary fuel injection apertures 36 formed in the intermediate duct 32, the fuel injectors 38 of the air/fuel supply system 40 could extend through apertures formed in other ducts, i.e., the transition duct 34 or the liner 18 at a location downstream from the main combustion zone 28, without departing from the sprit and scope of the invention.

As shown in FIG. 1, the fuel injectors 38 may be substantially equally spaced apart in the circumferential direction, although it is noted that the fuel injectors 38 may be configured in other patterns as desired, such as, for example, a random pattern. Further, the number, size, and location of the fuel injectors 38 and corresponding apertures 36 formed in the intermediate duct 32 may vary depending on the particular configuration of the combustor assembly 12 and the amount of fuel to be injected by the air/fuel supply system 40.

As noted above, the air/fuel supply system 40 comprises the fuel injectors 38, which will be discussed further below. The air/fuel supply system 40 further comprises a fuel dispensing structure 44, which, in the embodiment shown in FIGS. 1 and 2, comprises an annular fuel manifold having an inner cavity 46 that receives fuel to be distributed through the fuel injectors 38. The fuel dispensing structure 44 may extend completely or only partially around a circumference of the intermediate duct 32 depending on the number and location of fuel injectors 38 in the air/fuel supply system 40.

In the embodiment shown, a plurality of rigid support members 48 extend between the intermediate duct 32 and the fuel dispensing structure 44 to couple the fuel dispensing structure 44 to the intermediate duct 32, see FIG. 1. The support members 48 fixedly couple the fuel dispensing structure 44 directly to the intermediate duct 32 such that the intermediate duct 32 structurally supports the air/fuel supply system 40. It is noted that the air/fuel supply system 40 may be structurally supported by other structures, such as, for example, the flow sleeve 16, the main engine casing 20, or other suitable structures.

The fuel dispensing structure 44 communicates with second fuel supply structures 50, see FIG. 1, which second fuel supply structures 50 may receive fuel from the source of fuel 30 and deliver the fuel to the inner cavity 46 of the fuel dispensing structure 44. Fuel received by the fuel dispensing structure 44 is then provided to the fuel injectors 38, as will be discussed below.

Referring to FIGS. 2-4, one of the fuel injectors 38 of the air/fuel supply system 40 is shown, it being understood that the other fuel injectors 38 of the air/fuel supply system 40 are substantially similar to the fuel injector 38 illustrated in FIGS. 2-4. The fuel injector 38 comprises a main body 60 defining a longitudinal axis L that extends between an inlet end 62 and an outlet end 64 of the main body 60, see FIG. 2. The fuel injector 38 further comprises a nozzle structure 102, which nozzle structure 102 is further discussed below.

The fuel injector 38 comprises a plurality of air/fuel passages 66 extending therethrough. Each of the air/fuel passages 66 includes an inlet portion 68 generally located in a frusto-conical portion 60A of the main body 60, and having an inlet 68A that receives air from a source of air 70, which source of air 70 in the embodiment shown comprises compressor discharge air located outside of the combustor device 14, but could be other suitable sources of air. Each air/fuel passage 66 further includes an outlet portion 72 generally located in a cylindrical portion 60B of the main body 60, and having an outlet 72A that outputs an air/fuel mixture produced in the air/fuel passage 66, as will be discussed herein. As shown in FIG. 2, the inlet portions 68 of the air/fuel passages 66 extend transversely to the longitudinal axis L to locate the inlets 68A of the air/fuel passages 66 in the frusto-conical portion 60A. The air/fuel passages 66 each include a change in direction 73 (see FIG. 2) between the inlet portion 68 and the outlet portion 72 such that the outlet portions 72 extends substantially in the longitudinal direction. It is noted that the number and size of the air/fuel passages 66 included in the fuel injector 38 may vary depending upon the particular configuration of the engine in which the combustor assembly 12 is employed.

Figure 5:
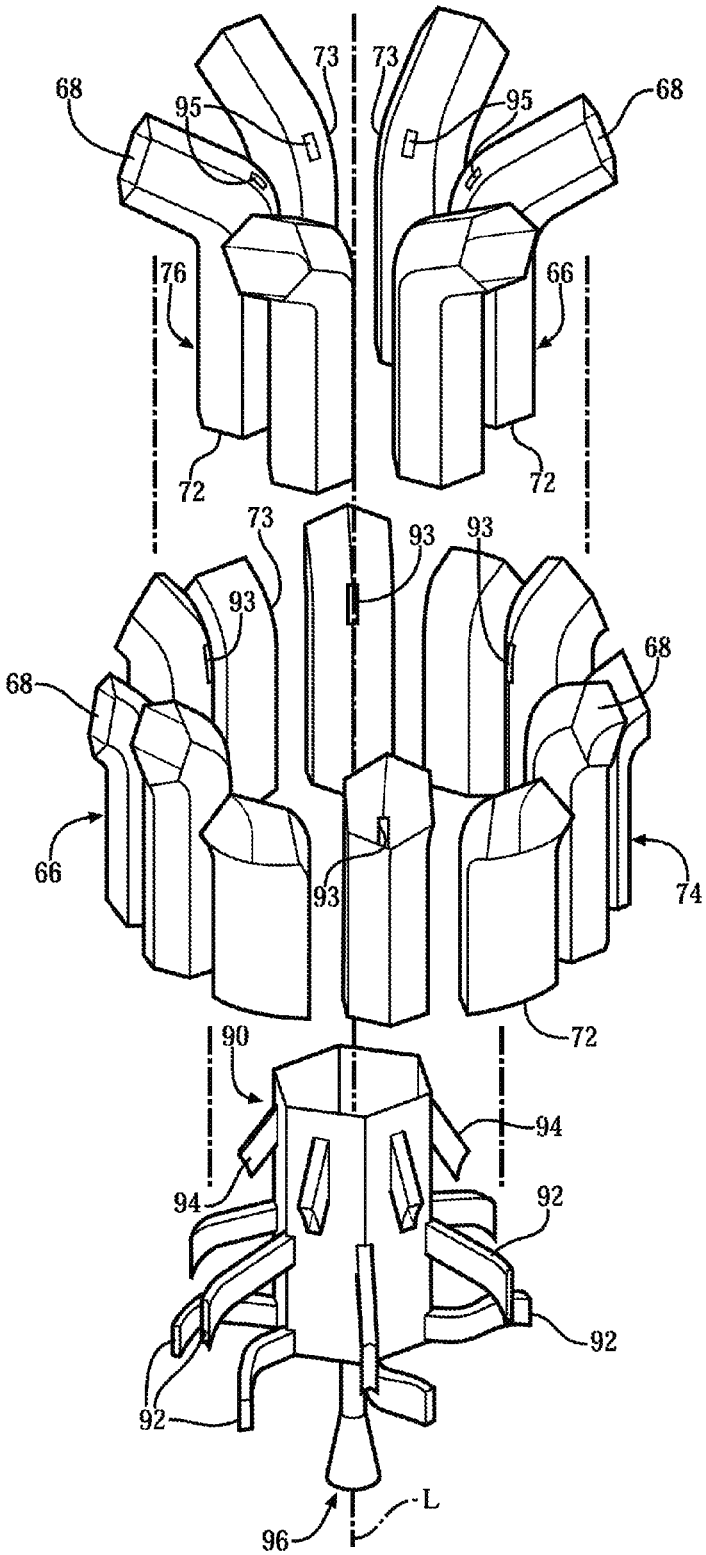
FIG. 5 is an enlarged exploded view diagrammatically illustrating a plurality of air/fuel passages and a fuel supply structure of the fuel injector illustrated in FIG. 3.

Referring additionally to FIG. 5, the air/fuel passages 66 in the embodiment shown are illustrated diagrammatically by outlines or contours corresponding to walls of the air/fuel passages 66. It is noted that a fuel supply structure 90, to be discussed below, is also illustrated diagrammatically by outlines or contours corresponding to walls of the fuel supply structure 90. The air/fuel passages 66 and fuel supply structure 90 may be defined by forming the main body 60 from a series of laminations joined together. The air/fuel passages 66 include a first set of air/fuel passages 74 and a second set of air/fuel passages 76, wherein the passages 66 of the second set of air/fuel passages 76 are located radially inwardly from the passages 66 of the first set of air/fuel passages 74 with respect to the longitudinal axis L. The passages 66 of the first and second sets of air/fuel passages 74 and 76 are each positioned in an annular array about the longitudinal axis L, such that the outlet portions 72 of the passages 74, 76 are located at successive radial locations from the longitudinal axis L, see FIG. 2. Such a configuration for the air/fuel passages 66 permits a substantial amount of air to flow into the fuel injector 38 and also substantially evenly distributes the air/fuel mixtures from the outlet end 64 of the main body 60.

As shown most clearly in FIG. 4, the air/fuel passages 66 preferably comprise hexagonal-shaped passages such that the outlet portions 72 thereof are positioned in a honeycomb configuration, although the air/fuel passages 66 could have other shapes as desired. With such a honeycomb configuration, a wall structure 80 of the main body 60 between adjacent ones of the air/fuel passages 66 (see FIGS. 2 and 4) comprises a thickness T (FIG. 4), measured in a plane P (FIG. 2) perpendicular to the longitudinal axis L, which is substantially uniform around a perimeter of each of the air/fuel passages 66. This configuration, in which excess wall thickness between adjacent passages 66 is substantially minimized, is believed to maximize the flow area of the individual passages 66 to maximize the flow of the air/fuel mixtures through the fuel injector 38.

As shown in FIGS. 2-4, the fuel injector 38 further comprises a generally cylindrical fuel conduit 84 aligned with the longitudinal axis L and including a plurality of radially extending fuel inlets 86. The fuel inlets 86 receive fuel from the fuel dispensing structure 44. The fuel inlets 86 may be sized to meter fuel flow into the fuel injector 38 to a desired flow rate. In the embodiment shown, the fuel conduit 84 is integrally formed with the main body 60, although it is understood that the fuel conduit 84 could be separate from and sealingly coupled to the main body 60 via, for example, brazing.

The fuel conduit 84 delivers the fuel from the fuel dispensing structure 44 to the fuel supply structure 90 of the fuel injector 38, see FIGS. 2 and 5. The fuel supply structure 90 extends in the longitudinal direction along the longitudinal axis L and distributes a majority of the fuel to the air/fuel passages 66 and distributes additional fuel out of the outlet end 64 of the main body 60. Specifically, a first set of isolated fuel distribution passages 92 of the fuel supply structure 90 provide a first portion of the fuel from the fuel supply structure 90 to the first set of air/fuel passages 74 via one or more fuel inlet openings 93 in the air/fuel passages 66 of the first set of air/fuel passages 74, at least some of which are adjacent to the change in direction 73. The first set of fuel distribution passages 92 individually deliver respective portions of fuel from the fuel supply structure 90 to each of the first set of air/fuel passages 74. That is, portions of fuel are respectively delivered directly from the fuel supply structure 90 to each of the first set of air/fuel passages 74 without mixing with portions of fuel being delivered to the others of the first set of air/fuel passages 74 via the first set of fuel distribution passages 92. A second set of isolated fuel distribution passages 94 of the fuel supply structure 90 provide a second portion of the fuel from the fuel supply structure 90 to the second set of air/fuel passages 76 via one or more fuel inlet openings 95 in the air/fuel passages 66 of the second set of air/fuel passages 76, at least some of which are adjacent to the change in direction 73. The second set of fuel distribution passages 94 individually deliver respective portions of fuel from the fuel supply structure 90 to each of the second set of air/fuel passages 76. That is, portions of fuel are respectively delivered directly from the fuel supply structure 90 to each of the second set of air/fuel passages 76 without mixing with portions of fuel being delivered to the others of the second set of air/fuel passages 76 via the second set of fuel distribution passages 94 or with portions of fuel being delivered to the first set of air/fuel passages 74 via the first set of fuel distribution passages 92. The fuel provided to the air/fuel passages 66 by the fuel supply structure 90 is mixed with the air in the air/fuel passages 66 from the source of air 70 to create air/fuel mixtures within each air/fuel passage 66, which air/fuel mixtures exit the main body 60 of the fuel injector 38 through the outlets 72A of the air/fuel passages 66. A third portion of the fuel from the fuel supply structure 90 in the embodiment shown is distributed longitudinally, i.e., in the direction of the longitudinal axis L. via a central outlet 96 of the fuel supply structure 90 located at the outlet end 64 of the main body 60, see FIGS. 2, 4, and 5. It is noted that all of the fuel from the fuel supply structure 90 could be distributed to the air/fuel passages 66 if the fuel injector 38 is not provided with the central outlet 96.

As shown in FIGS. 2 and 5, the fuel distribution passages 92, 94 of the fuel supply structure 90 extend away from the longitudinal axis L at an angle transverse to the longitudinal axis L of the fuel injector 38. Further, in the embodiment shown, at least some of the fuel distribution passages 92, 94 extend away from the longitudinal axis L (axial direction) in a direction including a component in the axial direction toward the outlet end 64 of the main body 60. This configuration is believed to promote the fuel entering the air/fuel passages 66 from the fuel supply structure 90 to flow toward the outlet end 64 of the main body 60, rather than toward the inlet end 62 of the main body 60. The axial component of the fuel distribution passages 92, 94 is also believed to prevent the air flow through the passages 66 from being substantially blocked by a high speed fuel flow out of the fuel distribution passages 92, 94. Moreover, it is noted that the first set of fuel distribution passages 92 pass between adjacent ones of the second set of air/fuel passages 76 to supply fuel to the first set of air/fuel passages 74.

The air/fuel mixtures from the air/fuel passages 66 are distributed from the outlet end 64 of the main body 60 into an inner volume 100 of the nozzle structure 102, see FIG. 2. The nozzle structure 102 comprises a first portion 104 that overlaps the outlet end 64 of the main body 60 and is coupled to the intermediate duct 32 within the secondary fuel injection aperture 36. The nozzle structure 102 may be slidably coupled to the intermediate duct 32 to allow for relative movement therebetween. Additional details in connection with such a slidable coupling between a fuel injector and a duct can be found in U.S. patent application Ser. No. 12/477,397, filed Jun. 3, 2009, entitled "COMBUSTOR APPARATUS FOR USE IN A GAS TURBINE ENGINE," the entire disclosure of which is hereby incorporated by reference herein.

As shown in FIG. 2, the first portion 104 of the nozzle structure 102 is spaced from a radially outer surface 106 of the outlet end 64 of the main body 60 such that a gap G is formed therebetween. The gap G permits air from the source of air 70 to pass into the inner volume 100 of the nozzle structure 102. In the embodiment shown, a plurality of spanning members 108 are located in the gap G and extend between the first portion 104 of the nozzle structure 102 and the radially outer surface 106 of the main body 60. The spanning members 108 substantially maintain the dimensions of the gap G to continuously permit air from the source of air 70 to pass into the inner volume 100 of the nozzle structure 102 during operation of the combustor assembly 12. Optionally, the spanning members 108 may be angled with respect to the longitudinal axis L of the main body 60 to effect a swirling flow of the air passing through the gap G into the inner volume 100 of the nozzle structure 102. The swirling flow of the air passing through the gap G may provide for a better and more turbulent mixture within the inner volume 100 of the nozzle structure 102, as will be discussed below.

As shown in FIG. 2, the nozzle structure 102 further comprises a second portion 110 that defines the inner volume 100 and receives the air/fuel mixtures discharged from the air/fuel passages 66 and the air from the source of air 70 that passes through the gap G. The air/fuel mixtures from the air/fuel passages 66 and the air from the source of air 70 are mixed within the inner volume 100 of the second portion 110 of the nozzle structure 102 to create a turbulent mixture of air and fuel, hereinafter "turbulent mixture." The second portion 110 of the nozzle structure 102 may comprise a converging nozzle wall 112, which converging nozzle wall 112 effects an increase in a velocity of the turbulent mixture as the turbulent mixture flows radially inwardly and out of the nozzle structure 102.

Referring back to FIG. 1, the turbulent mixture is injected by the fuel injector 38 into the secondary combustion zone 42 downstream from the main combustion zone 28. The turbulent mixture is ignited in the secondary combustion zone 42 by the combustion products from the main combustion zone 28 to create the additional hot working gases, as mentioned above. The additional working gases may form a ring of hot temperature gases around the hot working gases from the main combustion zone 28.

It is noted that the level of NOx production may be minimized by maintaining the combustion zone temperature below a level at which NOx is formed, and/or may be minimized by maintaining a short residence time for the combustion reactions in the combustion zone. Injecting fuel at a downstream location from the main combustion zone 28 via the air/fuel supply system 40 may reduce the production of NOx by the combustor assembly 12 due to a lower residence time for combustion reactions of the air/fuel mixture injected from the air/fuel supply system 40. In particular, a significant portion of the fuel may be injected at a location downstream of the main combustion zone 28 by the air/fuel supply system 40, e.g., during a high load operation of the gas turbine engine. Since the air/fuel mixture injected by the air/fuel supply system 40 is closer to the entrance to the turbine section of the engine, the residence time for combustion reactions occurring in the secondary combustion zone 42 and transition duct 34 is reduced as compared to injection of all of the fuel into the main combustion zone 28, and results in reduced NOx production.

In addition, in accordance with the present invention, it is believed that diffusion type combustion is substantially avoided by the present air/fuel supply system 40. It may be noted that in prior systems injecting only fuel, or air and fuel that is not substantially or completely premixed, may result in a diffusion type combustion in the secondary combustion zone 42. Such diffusion type combustion in the area of the fuel, or fuel and air injected into the combustion zone, may result in a fuel rich combustion comprising increased temperatures with resulting increased NOx production. In contrast, a substantially uniform or homogeneous mixture of air and fuel substantially eliminates fuel rich pockets that may create high flame temperature locations in the area of the combustion reactions, with corresponding NOx production.

The air/fuel mixture of the present air/fuel supply system 40 provides a substantially homogeneous mixture of air and fuel passing out of each of the passages 66 and out of the nozzle structure 102. In particular, it should be understood that the relatively small cross-sectional flow area of each of the passages 66 relative to the length of the passage 66 within which mixing of the air and fuel occurs, e.g., within the length of the outlet portion 72, facilitates a high degree of mixing of the air/fuel mixture in the passages 66 prior to discharge from the outlets 72A.

Further, it may be noted that the plurality of passages 66 provides a relatively large cumulative flow of air and fuel into the nozzle structure 102 where the plural air/fuel mixtures combine and form a substantially uniformly distributed homogeneous air/fuel mixture for discharge into the secondary combustion zone 42. The plurality of smaller mixing flows defined by the passages 66 enable the main body 60 to comprise a relatively short longitudinal length that may be positioned within a limited space, such as the space between the fuel manifold 44 and the intermediate duct wall.

The nozzle structure 102 provides a chamber defined by the inner volume 100 for combining the individual flows from the passages 66 into a common, larger flow for discharge into the secondary combustion zone 42, and for locating the air/fuel mixture discharge location, and associated combustion reaction, away from the inner surface of the intermediate duct wall. It may further be noted that provision of an air flow through the gap G may facilitate cooling of the nozzle structure wall to prevent or reduce heating of the combined air/fuel mixtures passing through the nozzle structure 102 prior to discharge from the nozzle structure 102. Still further, the combined air/fuel mixtures passing through the nozzle structure 102 may provide cooling to the nozzle structure wall.

By accomplishing a high degree of premixing in a relatively radially short fuel injector 38 and without requiring the nozzle structure 102 to extend too far into the secondary combustion zone 42, it is possible to control the discharge location for the air/fuel mixture and avoid overheating of the fuel injector 38, such as may occur as a result of exposure to the hot working gases flowing through the secondary combustion zone 42. This is advantageous, in that, a substantial extension of the fuel injector 38 into the secondary combustion zone 42 could subject the fuel injector 38 to overheating during operation of the engine. Further, a substantial extension of the fuel injector 38 into the secondary combustion zone 42, i.e., toward the center of the intermediate duct 32, could position the combustion reactions in the secondary combustion zone 42 too close to the centerline of the combustor assembly 12 where the flame is hottest, which could result in increased NOx production within the combustor assembly 12. For example, referring to FIG. 2, according to one aspect of the invention, the second portion 110 of the nozzle structure 102 may have a length $L_N$ of from about 1.0 to about 1.5 times an outlet diameter $D_N$ of the nozzle structure 102, and in a preferred embodiment has a length of no more than about 1.5 times the outlet diameter $D_N$ of the nozzle structure 102, wherein sufficient premixing can be accomplished in the fuel injector 38 within the air/fuel passages 66 and within the inner volume 100 of the nozzle structure 102.

FIGS. 6-9 illustrate optional and/or alternate configurations for components of fuel injectors according to other aspects of the invention. In FIGS. 6-9, structure similar to that described above with respect to FIGS. 1-5 includes the same last two digits, but the first digit of the structure in FIGS. 6-9 matches the corresponding figure number. For example, the fuel injectors 38 of FIGS. 1-5 are numbered 638 in FIG. 6, 738 in FIG. 7, etc.

Figure 6:
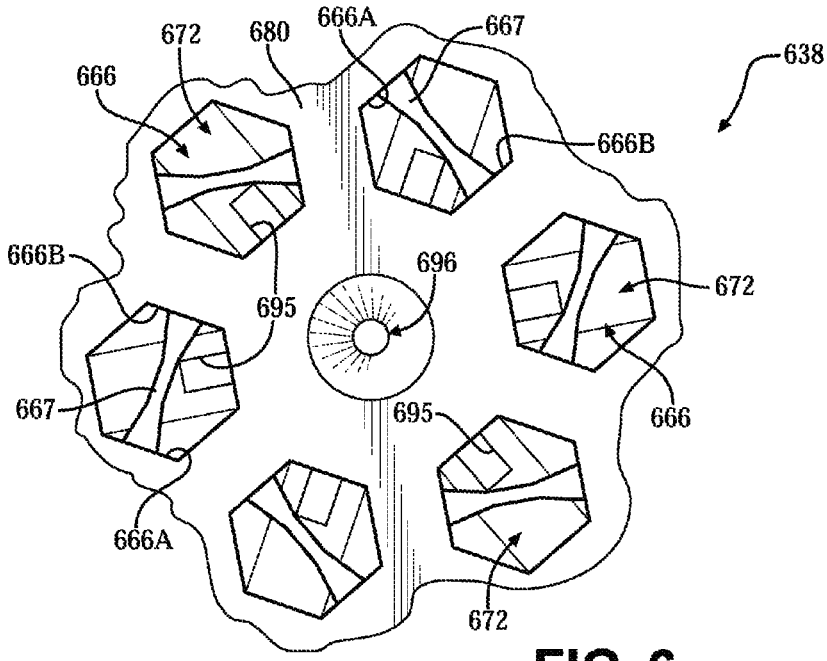
FIG. 6 is an enlarged view of a plurality of air/fuel passage outlets according to an embodiment of the invention.

Referring now to FIG. 6, outlet portions 672 of air/fuel passages 666 include spanning structures 667 than span between opposing air/fuel passage walls 666A, 666B. The spanning structure 667 provide for increased turbulence of the air/fuel mixtures passing out of the air/fuel passages 666 to create a better and more uniform mixture of air and fuel. It is noted that the spanning structures 667 may be located at various radial locations within the air/fuel passages 666. Remaining structure in FIG. 6 is the same as described above with respect to FIGS. 1-5.

Figure 7:
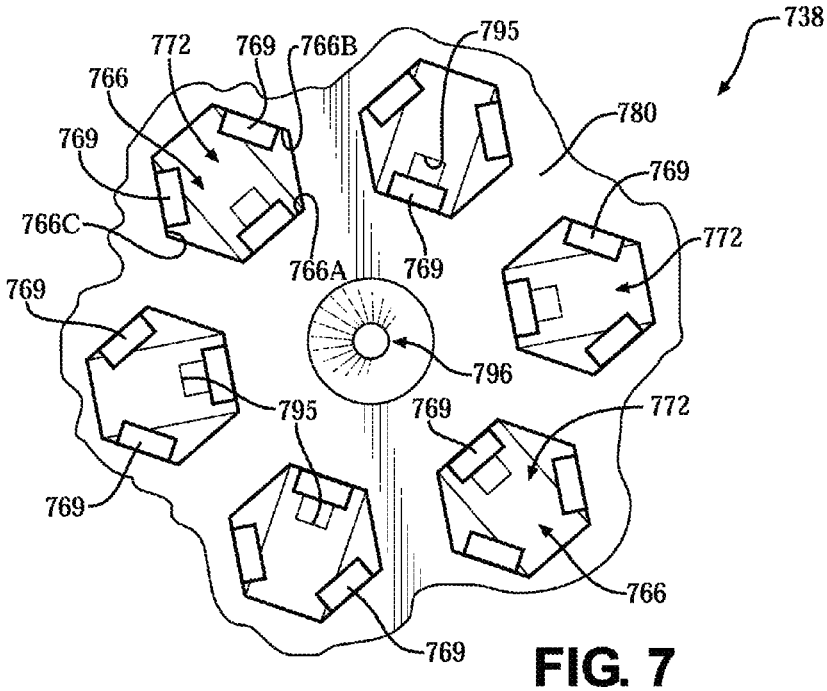
FIG. 7 is an enlarged view of a plurality of air/fuel passage outlets according to another embodiment of the invention.

Referring now to FIG. 7, outlet portions 772 of air/fuel passages 766 include a plurality of tab members 769 that extend outwardly from the air/fuel passage walls 766A, 766B, 766C. The tab members 769 provide for increased turbulence of the air/fuel mixtures passing out of the air/fuel passages 766 to create a better and more uniform mixture of air and fuel. It is noted that the tab members 769 may be located at various radial locations within the air/fuel passages 766. Remaining structure in FIG. 7 is the same as described above with respect to FIGS. 1-5.

Figure 8:
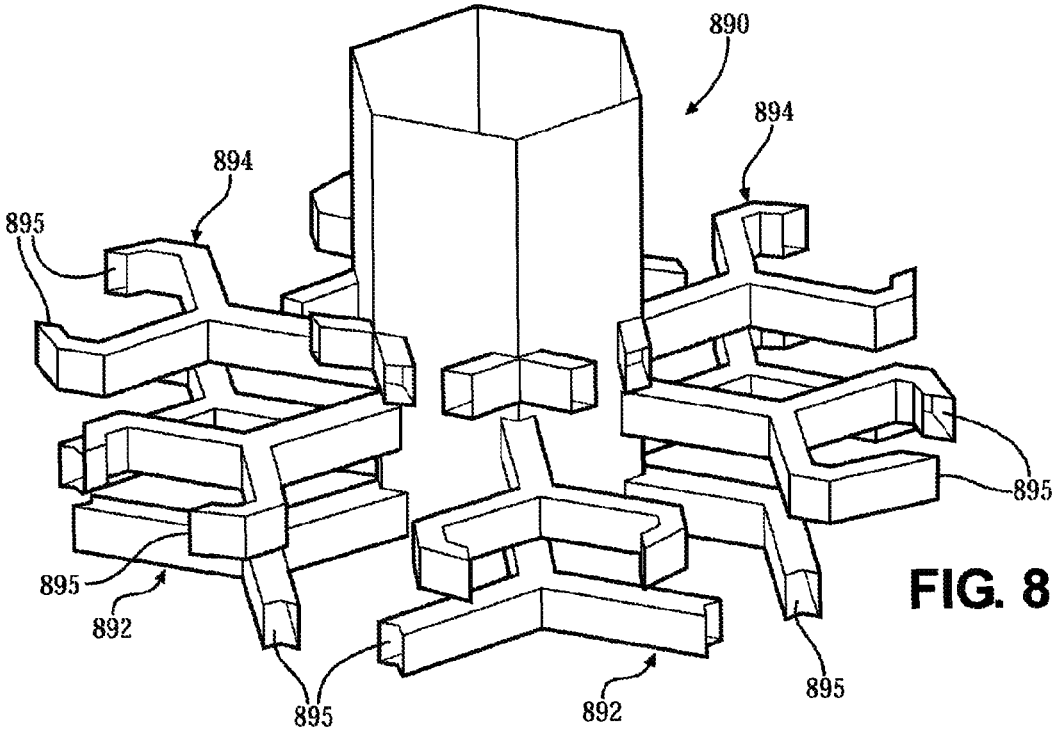
FIG. 8 is an enlarged perspective view diagrammatically illustrating a fuel supply structure according to yet another embodiment of the invention.

Referring now to FIG. 8, first and second sets of fuel distribution passages 892 and 894 of a fuel supply structure 890 each comprise multiple fuel outlets 897, wherein each fuel supply outlet 897 distributes fuel to a corresponding inlet opening (not shown) of an air/fuel passage (not shown). Distributing fuel to multiple locations within each air/fuel passage may create a better and more uniform mixture of air and fuel. Remaining structure in FIG. 8 is the same as described above with respect to FIGS. 1-5.

Figure 9:
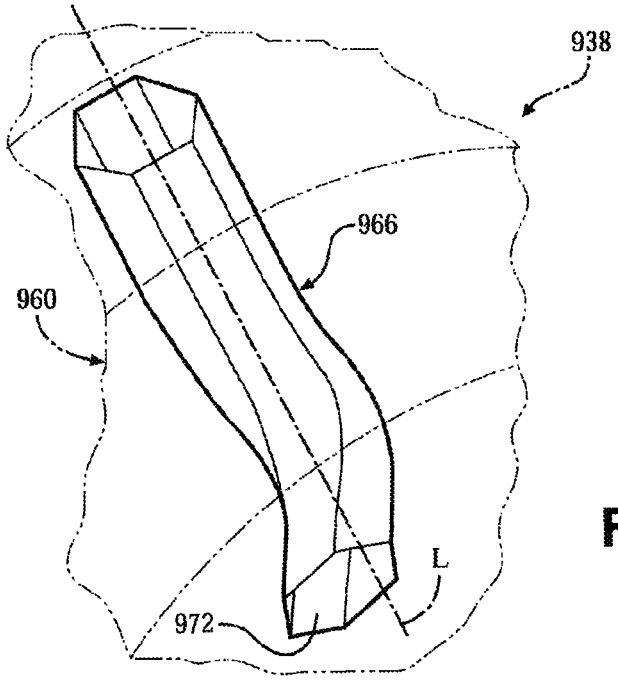
FIG. 9 is an enlarged view diagrammatically illustrating an air/fuel passage according to a further embodiment of the invention.

Referring now to FIG. 9, outlet portions 972 of air/fuel passages 966 are angled relative to a longitudinal axis L of a fuel injector 938 to effect a swirling flow of air/fuel mixtures discharged from the air/fuel passages 966. The swirling of the air/fuel mixtures may be in an opposite direction, e.g., clockwise vs. counterclockwise, to a swirling direction of air from a source of air (not shown in this embodiment) that flows through a gap (not shown in this embodiment) between a nozzle structure (not shown in this embodiment) and a main body portion 960 of the fuel injector 938, as discussed above with reference to FIG. 2. The swirling flow of the air/fuel mixtures may create a better and more uniform mixture of air and fuel that is injected by the fuel injector 938. Moreover, the swirling flow of the air/fuel mixtures produces a longer effective mixing length for the air/fuel mixtures, thus permitting the use of a radially shorter nozzle structure (not shown in this embodiment). Further, if the swirling flow of the air/fuel mixtures are in an opposite direction to that of the air that passes through the gap, the turbulence of the resulting turbulent mixture is increased, resulting in a better and more uniform turbulent mixture that is injected by the fuel injector 938. Remaining structure in FIG. 9 is the same as described above with respect to FIGS. 1-5.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuel injector for use in a combustor assembly of a gas turbine engine, the fuel injector comprising:

a main body having an inlet end and an outlet end and defining a longitudinal axis defining a longitudinal direction of the fuel injector and extending between said outlet end and said inlet end, said main body comprising a plurality of air/fuel passages extending therethrough, each air/fuel passage including an inlet that receives air from a source of air and an outlet, wherein said air/fuel passages comprise hexagonal-shaped passages positioned in a honeycomb configuration; and a fuel supply structure extending in said longitudinal direction and communicating with and supplying fuel to said air/fuel passages for providing an air/fuel mixture within each air/fuel passage, the air/fuel mixtures exiting said main body through respective air/fuel passage outlets, wherein said fuel supply structure includes isolated fuel distribution passages that individually deliver respective portions of fuel from said fuel supply structure to each of said air/fuel passages.

2. The fuel injector of claim 1, wherein:

said main body comprises a wall structure between said air/fuel passages and a thickness of said wall structure between adjacent air/fuel passages, measured in a plane perpendicular to said longitudinal axis, is substantially uniform around a perimeter of each said air/fuel passage.

3. The fuel injector of claim 1, wherein said fuel distribution passages extend transverse to said longitudinal axis for conveying fuel to each of said air/fuel passage.

4. The fuel injector of claim 3, wherein said fuel distribution passages extend away from said longitudinal axis in a direction including a component in said longitudinal direction toward said outlet end of said main body.

5. The fuel injector of claim 3, wherein said air/fuel passages include at least an outlet portion extending substantially in said longitudinal direction, said outlet portions located at successive radial locations from said longitudinal axis, and at least some of said fuel distribution passages pass between radially inner ones of said air/fuel passages to supply fuel to radially outer ones of said air/fuel passages.

6. The fuel injector of claim 1, further comprising a nozzle structure that receives the air/fuel mixtures from said main body and injects the air/fuel mixtures into a duct structure of the combustor assembly, said nozzle structure comprising:

a first portion overlapping said outlet end of said main body, said first portion being spaced from a radially outer surface of said outlet end of said main body such that a gap is formed therebetween, said gap permitting air to pass from said source of air into said nozzle structure; and a second portion receiving the air/fuel mixtures discharged from said air/fuel passages, said second portion comprising a converging nozzle wall, said converging wall effecting an increase in a velocity of the air/fuel mixtures discharged from said air/fuel passages as the air/fuel mixtures flow through said second portion of said nozzle structure.

7. The fuel injector of claim 6, further comprising a plurality of spanning members located within said gap and extending between said first portion of said nozzle structure and said radially outer surface of said main body, wherein said spanning members are angled with respect to said longitudinal axis of said main body to effect a swirling flow of the air passing through said gap.

8. The fuel injector of claim 1, wherein outlet portions of said air/fuel passages in fluid communication with said outlets are angled relative to said longitudinal axis to effect a swirling flow of the air/fuel mixtures discharged from said air/fuel passages.

9. The fuel injector of claim 1, wherein the air/fuel mixtures from said air/fuel passages are discharged into a secondary combustion zone downstream from a main combustion zone of the combustor assembly.

10. The fuel injector of claim 1, wherein said fuel supply structure further comprises a central outlet located at said outlet end of said main body, wherein additional fuel from said fuel supply structure exits said fuel supply structure in said longitudinal direction through said central outlet.

11. An air/fuel supply system for use in a combustor assembly of a gas turbine engine, the air/fuel supply system comprising:

a fuel injector comprising:

a main body having an inlet end and an outlet end and defining a longitudinal axis defining a longitudinal direction of said fuel injector and extending between said outlet end and said inlet end, said main body comprising a plurality of air/fuel passages extending therethrough, each air/fuel passage including an inlet that receives air from a source of air and an outlet, wherein said air/fuel passages comprise hexagonal-shaped passages positioned in a honeycomb configuration; and a fuel supply structure in said main body extending in said longitudinal direction, said fuel supply structure including at least one fuel inlet that receives fuel from a source of fuel and a plurality of fuel outlets, each said fuel outlet communicating with and supplying fuel to at least one of said air/fuel passages, wherein said fuel supply structure includes isolated fuel distribution passages that individually deliver respective portions of fuel from said fuel supply structure to each of said air fuel passages; and wherein air passing through each said air/fuel passage is mixed with fuel from at least one of said fuel outlets, said mixing occurring within each said air/fuel passage to produce an air/fuel mixture within each air/fuel passage, said air/fuel mixture within each said air/fuel passage exiting said outlet end of said main body through a respective air/fuel passage outlet.

12. The air/fuel supply system of claim 11, wherein said fuel supply structure further comprises a central passage extending in said longitudinal direction and said fuel distribution passages extend transversely to said longitudinal axis from said central passage to said air/fuel passages at respective ones of said fuel outlets.

13. The air/fuel supply system of claim 12, wherein said air/fuel passages are positioned in an annular array around said longitudinal axis.

14. The air/fuel supply system of claim 13, wherein:

said annular array comprises at least a first set of air/fuel passages and a second set of air/fuel passages located radially inwardly from said first set of air/fuel passages; and said fuel distribution passages include a first set of fuel distribution passages passing between adjacent ones of said second set of air/fuel passages to said first set of air/fuel passages and a second set of fuel distribution passages passing to said second set of air/fuel passages.

15. The air/fuel supply system of claim 14, wherein:

said main body comprises a wall structure between said air/fuel passages and a thickness of said wall structure between adjacent air/fuel passages, measured in a plane perpendicular to said longitudinal axis, is substantially uniform around a perimeter of each said air/fuel passage.

16. The air/fuel supply system of claim 12, wherein said fuel supply structure further comprises a central outlet in communication with said central passage and located at said outlet end of said main body, wherein additional fuel from said fuel supply structure exits said fuel supply structure in said longitudinal direction through said central outlet.

17. The air/fuel supply system of claim 11, wherein outlet portions of said air/fuel passages in fluid communication with said outlets are angled relative to said longitudinal axis to effect a swirling flow of the air/fuel mixtures discharged from said air/fuel passages.

18. The air/fuel supply system of claim 11, wherein the air/fuel supply system comprises a plurality of said fuel injectors, and wherein said fuel supply structure for each of said fuel injectors is connected to a fuel manifold of the combustor assembly.

19. The air/fuel supply system of claim 18, wherein the air/fuel mixtures from said air/fuel passages of each of said fuel injectors are discharged into a secondary combustion zone downstream from a main combustion zone of the combustor assembly.

20. The air/fuel supply system of claim 11, further comprising a nozzle structure that receives the air/fuel mixtures from said main body and injects the air/fuel mixtures into a duct structure of the combustor assembly, said nozzle structure comprising a portion defining an inner volume of said nozzle structure, said portion having a length of no more than about 1.5 times an outlet diameter of said nozzle structure.

* * * * *